US010746052B2

(12) United States Patent
Watanabe et al.

(10) Patent No.: US 10,746,052 B2
(45) Date of Patent: Aug. 18, 2020

(54) CASING FOR RADIAL COMPRESSOR, AND RADIAL COMPRESSOR

(71) Applicant: MITSUBISHI HEAVY INDUSTRIES ENGINE & TURBOCHARGER, LTD., Sagamihara-shi, Kanagawa (JP)

(72) Inventors: Yasunori Watanabe, Tokyo (JP); Ryoji Okabe, Tokyo (JP); Kenichiro Iwakiri, Tokyo (JP); Tadashi Kanzaka, Tokyo (JP)

(73) Assignee: MITSUBISHI HEAVY INDUSTRIES ENGINE & TURBOCHARGER, LTD., Sagamihara-Shi (JP)

( * ) Notice: Subject to any disclaimer, the term of this patent is extended or adjusted under 35 U.S.C. 154(b) by 155 days.

(21) Appl. No.: 16/088,522

(22) PCT Filed: Mar. 31, 2016

(86) PCT No.: PCT/JP2016/061642

§ 371 (c)(1),
(2) Date: Sep. 26, 2018

(87) PCT Pub. No.: WO2017/168767

PCT Pub. Date: Oct. 5, 2017

(65) Prior Publication Data

US 2020/0123931 A1 Apr. 23, 2020

(51) Int. Cl.
*F04D 29/42* (2006.01)
*F01D 25/24* (2006.01)
(Continued)

(52) U.S. Cl.
CPC ..... *F01D 25/24* (2013.01); *F01D 9/026* (2013.01); *F04D 29/4213* (2013.01);
(Continued)

(58) Field of Classification Search
CPC ..... F04D 29/023; F04D 29/4206; F04D 29/4213; F05D 2250/51
See application file for complete search history.

(56) References Cited

U.S. PATENT DOCUMENTS 6,193,463 B1 * 2/2001 Adeff ..... F04D 29/023 415/196
7,001,148 B2 * 2/2006 Cardenas ..... F04D 25/04 415/196
(Continued)

FOREIGN PATENT DOCUMENTS

CN 1707123 A 12/2005
CN 101560987 A 10/2009
(Continued)

OTHER PUBLICATIONS

International Search Report dated Aug. 2, 2016 in PCT Application No. PCT/JP2016/061642 with an English Translation.
(Continued)

*Primary Examiner* — Ninh H. Nguyen
(74) *Attorney, Agent, or Firm* — Birch, Stewart, Kolasch & Birch, LLP

(57) ABSTRACT

The present invention provides a casing for a radial compressor including: a scroll portion which is disposed on an outer circumferential side of an impeller and an intake portion and extends in a circumferential direction, has a discharge port opening in a circumferential direction and a scroll flow path through which the gas from the impeller flows toward the discharge port, and includes a resin material having a gradually increasing external shape dimension; and a plurality of ribs which connect an outer circumferential surface of the intake portion and an outer surface of the scroll portion. The plurality of ribs are provided at intervals in the circumferential direction, an installation interval gradually decreases toward the discharge port in the circumferential direction, and a length dimension in a radial direction on the outer surface of the scroll portion gradually decreases.

8 Claims, 6 Drawing Sheets

(51) Int. Cl.

| | |
|---|---|
| ***F01D 9/02*** | (2006.01) |
| *F04D 29/02* | (2006.01) |
| *F04D 29/28* | (2006.01) |

(52) U.S. Cl.
CPC ..... *F04D 29/023* (2013.01); *F04D 29/284* (2013.01); *F04D 29/4206* (2013.01); *F05C 2225/08* (2013.01); *F05D 2220/40* (2013.01); *F05D 2250/51* (2013.01); *F05D 2300/603* (2013.01)

(56) References Cited

U.S. PATENT DOCUMENTS

| | | | | |
|---|---|---|---|---|
| 8,419,359 | B2 * | 4/2013 | Cvjeticanin ..... | B29C 45/14467 415/200 |
| 2007/0036662 | A1 | 2/2007 | Pesola et al. | |
| 2009/0053051 | A1 | 2/2009 | Cvjeticanin | |
| 2009/0263234 | A1 | 10/2009 | Yin | |
| 2012/0099980 | A1 | 4/2012 | Nishita et al. | |
| 2013/0094953 | A1 | 4/2013 | Spathias et al. | |
| 2017/0276142 | A1 * | 9/2017 | Graham ..... | F04D 17/10 |

FOREIGN PATENT DOCUMENTS

| | | | |
|---|---|---|---|
| CN | 101896726 | A | 11/2010 |
| CN | 101019058 | A | 9/2011 |
| DE | 10 2008 056 512 | A1 | 5/2010 |
| EP | 0492604 | A2 | 7/1992 |
| EP | 2 110 557 | A1 | 5/2009 |
| GB | 2414769 | A | 12/2005 |
| JP | 2007-46610 | A | 2/2007 |
| JP | 2011-503439 | A | 1/2011 |
| JP | 5020382 | B2 | 9/2012 |
| JP | 2012-524860 | A | 10/2012 |
| JP | 5769317 | B2 | 8/2015 |

OTHER PUBLICATIONS

Written Opinion dated Aug. 2, 2016 in PCT Application No. PCT/IP2016/061642 with an English Translation.

* cited by examiner

CASING FOR RADIAL COMPRESSOR, AND RADIAL COMPRESSOR

TECHNICAL FIELD

The present invention relates to a casing for a radial compressor and a radial compressor.

BACKGROUND ART

A radial compressor is known as a kind of compressor. In a radial compressor, gas flowing out from an impeller is introduced into a scroll portion having a flow path formed in a spiral shape, and discharged by being guided in a circumferential direction. External dimensions of the scroll portion gradually increase from a winding start side to a discharge side.

Here, as in the radial compressors described in Patent Document 1 and 2, for example, in some cases, a casing for a radial compressor used in a turbocharger of an automobile is made of resin for weight reduction or the like.

CITATION LIST

Patent Document

[Patent Document 1]
Translation of PCT International Application No. 2011-503439
[Patent Document 2]
Translation of PCT International Application No. 2012-524860

SUMMARY OF INVENTION

Technical Problem

However, since resins have a lower thermal conductivity than metals such as aluminum, it is difficult for sufficient heat to be radiated from a casing when the casing of a compressor is made of resin. Therefore, there is a likelihood that the scroll portion of a casing will be greatly deformed due to thermal expansion due to high temperatures in the casing. Since the external dimensions of the scroll portion are larger on the discharge side than on the winding start side, an amount of thermal deformation (size of deformation) in the scroll portion on the discharge side will be larger. As a result, the scroll portion thermally deforms non-uniformly in the circumferential direction, and a tip clearance thereof from the impeller may become uneven in the circumferential direction. That is, the casing may be deformed so as to be inclined with respect to a rotational axis of the impeller. As a result, there is a problem that the performance of the compressor deteriorates.

Furthermore, if the compressor is used continuously, creep deformation may occur in a casing made of resin, and there is a likelihood that the performance at the start of use thereof may not be reproducible.

The present invention provides a casing for a radial compressor and a radial compressor in which deterioration of performance due to thermal deformation of a scroll portion is able to be curbed.

Solution to Problem

A casing for a radial compressor according to a first aspect of the present invention is a casing for a radial compressor including an intake portion for introducing a gas into an impeller and having a cylindrical shape extending in a direction of a rotational axis of the impeller and opening in a direction of the rotational axis; a scroll portion which is disposed on an outer circumferential side of the impeller and the intake portion to extend in a circumferential direction, has a discharge port opening in the circumferential direction and a scroll flow path through which the gas from the impeller flows toward the discharge port, and includes a resin material having gradually increasing external shape dimension; and a plurality of ribs connecting the outer circumferential surface of the intake portion to the outer surface of the scroll portion, wherein the plurality of ribs are provided in the circumferential direction of the scroll portion with intervals therebetween, and a placement interval therebetween and a radial length dimension thereof on the outer surface of the scroll portion gradually decrease toward the discharge port in the circumferential direction.

In such a casing, since the plurality of ribs are provided at interval in the circumferential direction of the scroll portion, it is possible to improve the rigidity in a portion between the intake portion and the scroll portion, and to suppress thermal deformation of the scroll portion.

Further, the external shape dimension of the scroll portion gradually increases toward the discharge side in the circumferential direction. Therefore, if no ribs are provided, the amount of thermal deformation on the discharge side becomes larger than that on the winding start side of the scroll portion. Here, by reducing the installation interval of the ribs toward the discharge side, it is possible to suppress thermal deformation in the direction of the rotational axis, while promoting thermal deformation of the scroll portion in the radial direction on the discharge side as compared with the winding start side. On the other hand, since the radial dimension of the rib on the outer surface of the scroll portion is higher at the winding start side, the rigidity of the scroll portion is higher on the winding start side than on the discharge side. Therefore, in the scroll portion of the winding start side, thermal deformation occurs uniformly in the direction of the rotational axis and in the radial direction. As a result, the amount of thermal deformation in the direction of the rotational axis can be made the same on the discharge side in which the amount of thermal deformation in the direction of the rotational axis is larger than the winding start side, and on the winding start side in which the amount of thermal deformation in the direction of the rotational axis is smaller than the discharge side. Therefore, the tip clearance between the impeller and the casing can be made uniform in the circumferential direction.

Further, by reducing the installation interval of the rib on the discharge side to suppress the amount of thermal deformation of the scroll portion in the direction of the rotational axis on the discharge side, it is possible to suppress the inclination of the intake portion with respect to the rotational axis due to thermal deformation of the scroll portion on the discharge side.

Further, in the casing for the radial compressor according to a second aspect of the present invention, the casing for the radial compressor according to the first aspect may further include an inner cylindrical portion which is disposed on an inner circumferential side of the intake portion and forms a cylindrical shape through which the gas flows; and an inner rib which is configured to connect the inner circumferential surface of the intake portion and the inner cylindrical portion.

By providing the inner cylindrical portion inside the intake portion and fixing the intake portion and the inner cylindrical portion with the inner rib, it is possible to provide a double pipe structure and to improve the rigidity of the intake portion. Therefore, thermal deformation of the intake portion can be further suppressed. As a result, a change in tip clearance with the impeller can be suppressed, and the performance deterioration of the radial compressor can be suppressed.

In the casing for the radial compressor according to a third aspect of the present invention, a space communicating with an inner side of the inner cylindrical portion may be defined between the intake portion and the inner cylindrical portion of the casing for the radial compressor of the second aspect, on both sides of the inner cylindrical portion in the direction of the rotational axis.

By providing such a space between the intake portion and the inner cylindrical portion, a part of the gas flowing out from the impeller toward the scroll portion can be returned to the intake portion using the space, and a part of the gas can be made to flow into the impeller through the inner side of the inner cylindrical portion again. That is, the space can be made to function as a recirculation path for the gas. Due to the recirculation of the gas, occurrence of surging can be suppressed and the operation range of the radial compressor can be expanded. Further, since the inner cylindrical portion and the intake portion are connected by the inner ribs, a space through which gas can be recirculated between the inner cylindrical portion and the intake portion can be easily provided between the inner ribs.

Further, in the casing for the radial compressor according to a fourth aspect of the present invention, the intake portion of the casing for the radial compressor according to any one of the first to third aspects may be made of resin, and the scroll portion may include a first main body portion made of resin which forms an inner surface of the scroll flow path at one side in the direction of the rotational axis, a second main body portion which faces the first main body portion in the direction of the rotational axis and forms an inner surface of the scroll flow path at the other side in the direction of the rotational axis, a diffuser portion which is disposed at a position sandwiched between the intake portion and the impeller in the direction of the rotational axis on an inner side in the radial direction of the second main body portion, forms an inner surface on the inner side in the radial direction of the scroll flow path, and is configured to guide the gas from the impeller to the scroll flow path, and a metallic sleeve having a cylindrical shape which is disposed at a position sandwiched between the diffuser portion and the intake portion in the direction of the rotational axis and comes into contact with the inner surface of the intake portion.

As described above, since the intake portion and the first main body portion are made of resin, they can be integrally molded by resin. Therefore, it is possible to save time and labor for manufacturing, and it is possible to reduce the costs and shorten the manufacturing time. Furthermore, if the intake portion is made of resin, if the sleeve is preliminarily inserted into the metal mold, for example, when the intake portion and the first main body portion are formed by injection-molding of resin, it is possible suppress deformation of the intake portion and the first main body portion due to shrinkage of the resin in a cooling process of the injection molding. Therefore, the tip clearance with the impeller can be set to the designed value, without performing post-processing on the surface of the diffuser facing the impeller.

Further, even if the impeller breaks, it is possible to prevent fragments of the impeller broken by the metallic sleeve from scattering to the outside of the compressor.

Further, in the casing for the radial compressor according to a fifth aspect of the present invention, the sleeve of the casing for the radial compressor according to the fourth aspect may include a cylindrical portion extending in the direction of the rotational axis, a flange portion which annularly protrudes radially outward at an end portion on the other side in the cylindrical portion, is disposed in a region sandwiched between the first main body portion and the diffuser portion in the direction of the rotational axis, and in which a surface facing one side in the direction of the rotational axis comes into contact with the first main body portion, wherein the scroll portion may further include a filling material filled into the region in which the flange portion is disposed.

By providing the flange portion on the sleeve and by filling the filling material in the region sandwiched between the first main body portion around the flange portion and the diffuser portion, it is possible to prevent the high-pressure gas inside the scroll flow path from flowing backward into the intake portion through this region. Further, the first main body portion and the diffuser portion are fixed via the flange portion. Since the flange portion is formed of metal, an amount of thermal deformation is small. Therefore, it is possible to suppress a change in the relative position of the diffuser portion with respect to the impeller due to the thermal deformation of the first main body portion made of resin or the intake portion made of resin having a high amount of thermal deformation. Therefore, it is possible to suppress a change in tip clearance with the impeller, and the performance of the radial compressor can be maintained.

Further, in the casing for the radial compressor according to a sixth aspect of the present invention, the surface of the sleeve of the casing for the radial compressor of the fourth or fifth aspect may be a rough surface.

In this way, since the surface of the sleeve is a rough surface, it is possible to fix the sleeve to the intake portion at a predetermined position.

Further, in the casing for the radial compressor according to a seventh aspect of the present invention, a material of the second main body portion of the casing for the radial compressor according to the fourth to sixth aspects may be a material with a conductivity higher than that of the material of the first main body portion.

By making the thermal conductivity of the second main body portion larger than that of the first main body portion made of resin in this manner, heat radiation from the scroll portion can be promoted, thermal deformation of the scroll portion is suppressed, and it is possible to suppress the change in the tip clearance of the impeller. Therefore, the performance of the radial compressor can be maintained.

Further, a casing for a radial compressor according to an eighth aspect of the present invention includes an impeller; a rotary shaft to which the impeller is fitted and which rotates together with the impeller; and the casing according to any one of the first to seventh aspects which covers the impeller.

In this way, since the radial compressor includes the casing, thermal deformation of the scroll portion can be suppressed by the ribs.

Further, thermal deformation in the direction of the rotational axis can be suppressed, while promoting thermal deformation of the scroll portion in the radial direction on the discharge side of the scroll portion, as compared with the winding start side. On the other hand, more uniform thermal deformation occurs on the winding start side in the direction of the rotational axis and in the radial direction. Therefore, it is possible to make the amount of thermal deformation in the direction of the rotational axis uniform on the discharge side and the winding start side of the scroll portion, and to make the tip clearance uniform in the circumferential direction.

Furthermore, by controlling the amount of thermal deformation of the scroll portion in the direction of the rotational axis on the discharge side, it is possible to suppress inclination of the intake portion with respect to the rotational axis due to thermal deformation of the scroll portion on the discharge side.

Advantageous Effects of Invention

In the casing for the radial compressor and the radial compressor, it is possible to suppress performance deterioration due to thermal deformation of the scroll portion, by providing a plurality of ribs which is configured to connect the intake portion and the scroll portion.

DESCRIPTION OF EMBODIMENTS

Hereinafter, a radial compressor 1 according to the embodiment of the present invention will be described.

The radial compressor 1 (hereinafter simply referred to as a compressor 1) is, for example, a compressor for a turbocharger mounted on a vehicle.

Figure 1:
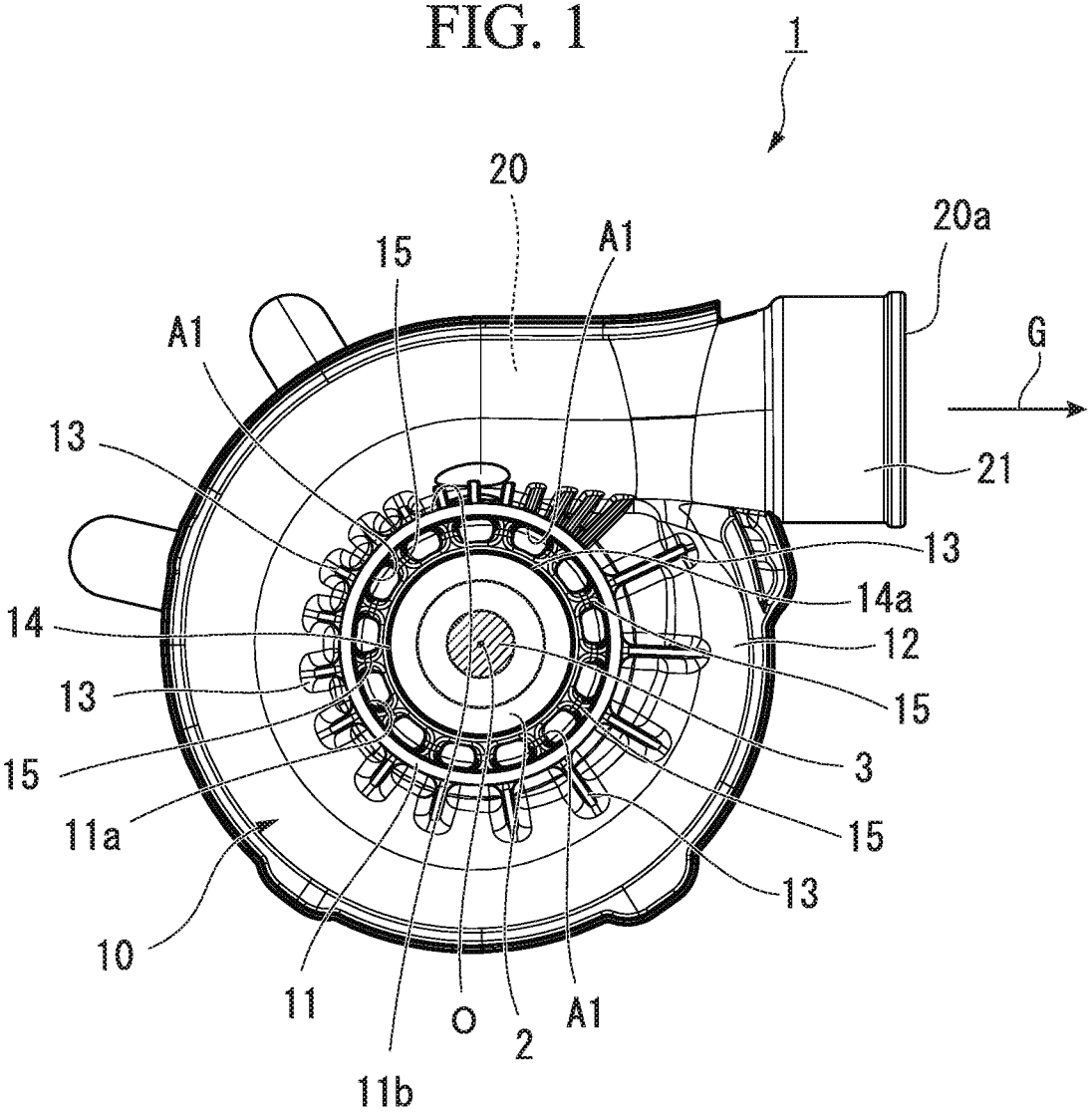
FIG. 1 is an overall top view of a radial compressor according to an embodiment of the present invention.
Figure 2:
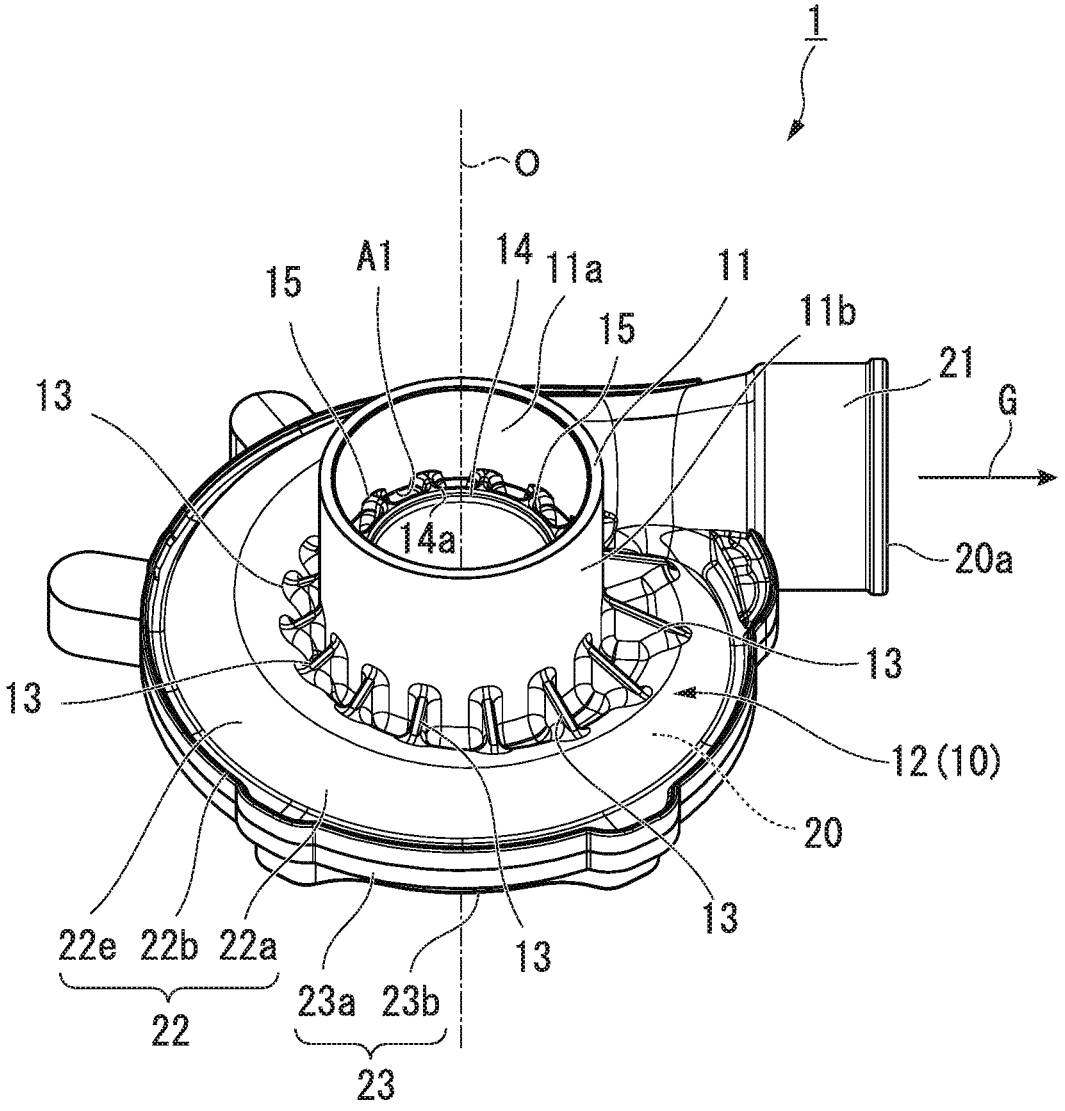
FIG. 2 is an overall perspective view of the radial compressor according to the embodiment of the present invention.

As shown in FIGS. 1 and 2, the compressor 1 includes an impeller 2, a rotary shaft 3 that rotates about the rotational axis O integrally with the impeller 2 by fitting the impeller 2, and a casing 10 that covers the impeller 2.

Next, the casing 10 will be described.

Figure 3:
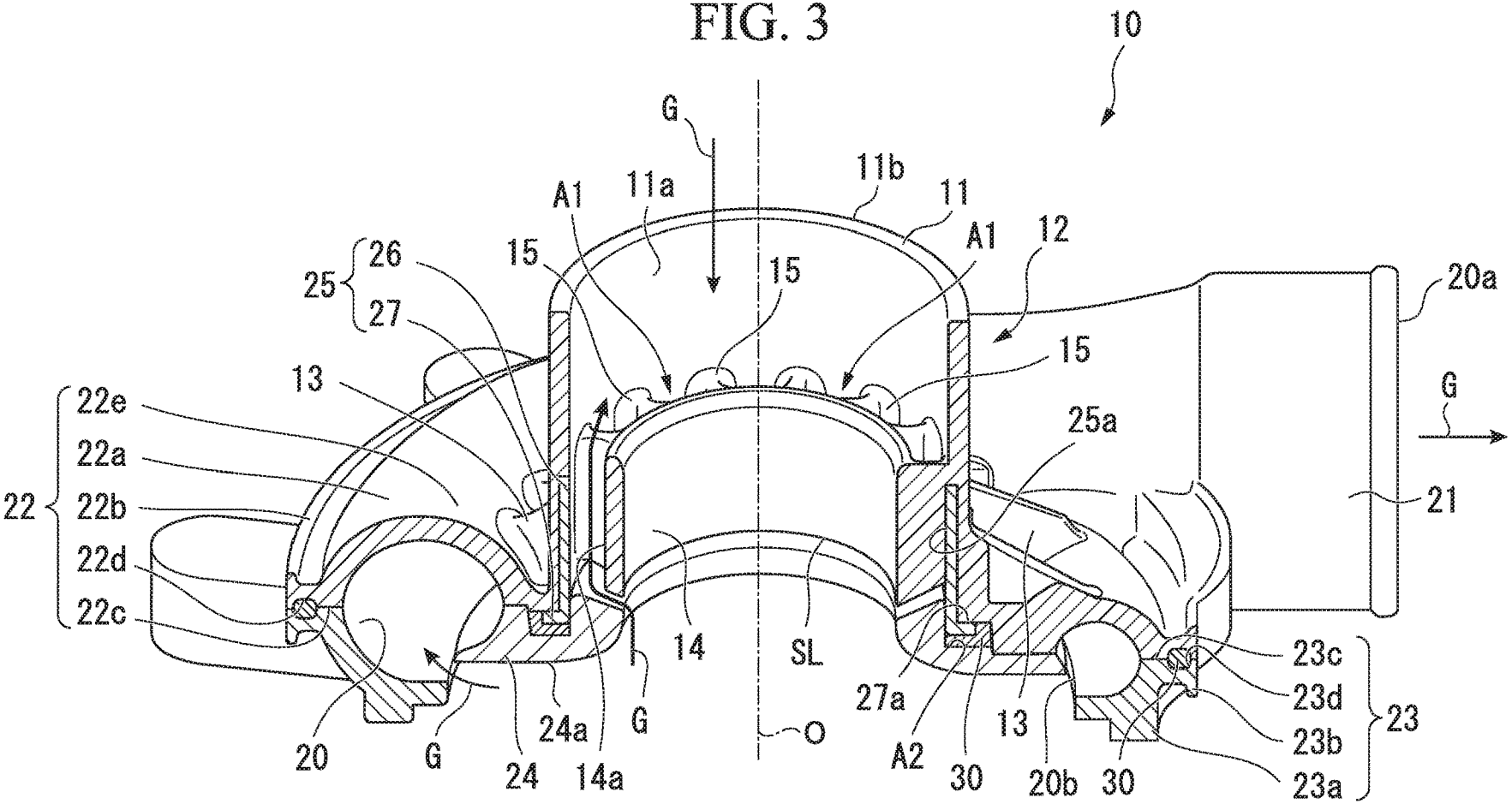
FIG. 3 is a longitudinal cross-sectional view of a casing for the radial compressor according to the embodiment of the present invention.

As shown in FIGS. 1 to 3, the casing 10 includes an intake portion 11 which introduces a gas G (for example, air) to the impeller 2, a scroll portion 12 including a resin material through which the gas G flowing out from the impeller 2 flows and from which the gas G is discharged, and a plurality of ribs 13 which connect the intake portion 11 and the scroll portion 12. The casing 10 further includes an inner cylindrical portion 14 disposed inside the intake portion 11, and a plurality of inner ribs 15 which connect the intake portion 11 and the inner cylindrical portion 14.

The intake portion 11 is disposed in one direction in the direction of the rotational axis O with respect to the impeller 2, extends in the direction of the rotational axis O, and has a cylindrical shape which opens in the direction of the rotational axis O. The intake portion 11 suctions the gas G from one side in the direction of the rotational axis O toward the impeller 2 and introduces the gas G toward a flow path (not shown) of the impeller 2. Further, the material of the intake portion 11 is a resin such as a thermoplastic plastic (for example, PPS (polyphenylene sulfide), PPA (polyphthalamide), PA9T/PA46/PA6T (polyamide), PBT (polybutylene terephthalate) and the like).

The scroll portion 12 is disposed on the outer circumferential side of the impeller 2 and the intake portion 11. The scroll portion 12 has a scroll flow path 20 that extends annularly in the circumferential direction of the impeller 2 and the rotary shaft 3 therein. The scroll portion 12 further has a cylindrical discharge port 21 which is provided at one end portion in the circumferential direction and forms an opening portion 20*a* of the scroll flow path 20.

Here, an end portion of the scroll portion 12 on one side in the circumferential direction which is the discharge port 21 side is defined as discharge side of the scroll portion 12, and an end portion on the other side in the circumferential direction is defined as a winding start side of the scroll portion 12. The end portion on the discharge side and the end portion on the winding start side are adjacent to each other.

In the scroll flow path 20, a flow path cross-sectional area in a cross-section orthogonal to the circumferential direction gradually increases from the winding start side to the discharge side. As a result, the external shape dimension of the scroll portion 12 gradually increases from the winding start side to the discharge side. Further, the shape of the flow path cross-section in a cross-section orthogonal to the circumferential direction of the scroll flow path 20 is circular. Thus, the external shape of the surface of the scroll portion 12 facing the direction of the rotational axis O is formed in a curved shape along the shape of the scroll flow path 20.

Further, the scroll portion 12 includes a first main body portion 22 which forms an inner surface of the scroll flow path 20 at one of the rotational axis O, a second main body portion 23 which forms the inner surface of the scroll flow path 20 at the other of the rotational axis O, a diffuser portion 24 which forms an inner surface of the scroll flow path 20 on the inner side in the radial direction, and a sleeve 25 disposed between the diffuser portion 24 and the intake portion 11.

The first main body portion 22 has an annular shape with the rotational axis O as a center. The first main body portion 22, which is a portion of the scroll portion 12 on one side in the direction of the rotational axis O, is provided to surround the outer circumferential surface 11*b* of the intake portion 11 from the outer circumference. Further, the first main body portion 22 is made of resin similarly to the intake portion 11. For example, the first main body portion 22 may be an injection-molded product of a resin integral with the intake portion 11, or the first main body portion 22 may be manufactured separately from the intake portion 11 and joined to the intake portion 11. The first main body portion 22 is connected to the discharge port 21 at the end portion on one side in the circumferential direction. In the present embodiment, the first main body portion 22 and the discharge port 21 are integrally manufactured.

Specifically, the first main body portion 22 has an annular portion 22*a* which has an annular shape with the rotational axis O as the center, and a protruding portion 22*b* which protrudes in the circumferential direction along the rotational axis O to one side in the direction of the rotational axis O, over the circumferential direction at an outer end portion (an outer circumferential end) in the radial direction of the annular portion 22*a*. Further, the first main body portion 22 has a surface 22*c* which is provided at the outer end portion (the outer circumferential end) in the radial direction of the annular portion 22*a* and faces the other side in the direction of the rotational axis O, and a recessed portion 22*d* which is recessed from the surface 22*c* to one side of the direction of the rotational axis O over the circumferential direction.

The second main body portion 23 has an annular portion 23*a* which has an annular shape with the rotational axis O as the center, and a protruding portion 23*b* which protrudes to the other side in the direction of the rotational axis O in the rotational axis O, over the circumferential direction at the outer end portion (the outer circumferential end) of the annular portion 23*a* in the radial direction. Further, the second main body portion 23 has a surface 23*c* which is provided at the outer end portion (the outer circumferential end) in the radial direction and faces one side in the direction of the rotational axis O, and a recessed portion 23*d* which is recessed in the circumferential direction from the surface 23*c* to the other side in the direction of the rotational axis O.

In addition, the second main body portion 23 is made of resin similarly to the intake portion 11 and the first main body portion 22. The second main body portion 23 is provided to face the first main body portion 22 in the direction of the rotational axis O. In the present embodiment, the second main body portion 23 is manufactured separately from the first main body portion 22 and joined to the first main body portion 22. More specifically, the surface 23*c* of the second main body portion 23 and the surface 22*c* of the first main body portion 22 are in contact with each other, and the recessed portion 23*d* of the second main body portion 23 and the recessed portion 22*d* of the first main body portion 22 are disposed at the same position in the radial direction, and the recessed portion 23*d* and the recessed portion 22*d* face each other in the direction of the rotational axis O. A space surrounded by the recessed portion 23*d* and the recessed portion 22*d* is filled with resin or the like, and the first main body portion 22 and the second main body portion 23 are joined to each other.

The diffuser portion 24 has an annular shape with the rotational axis O as a center. The diffuser portion 24 is disposed at a position on a radially inner side of the second main body portion 23 and sandwiched between the intake portion 11 and the impeller 2 in the direction of the rotational axis O.

The facing surface 24*a* of the diffuser portion 24 facing the impeller 2 is formed in a shape corresponding to a blade tip profile of the impeller 2. The distance between the facing surface 24*a* and the impeller 2 is a tip clearance.

Further, the other end portion of the second main body portion 23 in the direction of the rotational axis O is located on the other side of the rotational axis O from the facing surface 24*a* of the diffuser portion 24. As a result, the scroll flow path 20 has an opening portion 20*b* which opens annularly inward in the radial direction. The gas G flowing out from the impeller 2 flows into the scroll flow path 20 from the opening portion 20*b*.

In the present embodiment, the diffuser portion 24 is manufactured separately from the first main body portion 22 and the second main body portion 23, and is joined to the first main body portion 22 from the other side in the direction of the rotational axis O.

The sleeve 25 is disposed at a position sandwiched between the diffuser portion 24 and the intake portion 11 in the direction of the rotational axis O. The sleeve 25 is made of metal. The sleeve 25 is provided with a cylindrical portion 26 extending in the direction of the rotational axis O, and a flange portion 27 provided integrally with the cylindrical portion 26 at the other end portion of the cylindrical portion 26 in the direction of the rotational axis O.

The cylindrical portion 26 has a cylindrical shape centered on the rotational axis O. The surface of the sleeve 25 is roughened by performing roughening treatment such as blasting, laser and knurling. The inner circumferential surface 25*a* of the sleeve 25 is flush with the inner circumferential surface 11*a* of the intake portion 11 so that no step is formed between the inner circumferential surface 25*a* and the inner circumferential surface 11*a* of the intake portion 11.

The flange portion 27 has an annular shape with the rotational axis O as a center. The flange portion 27 protrudes radially outward from the outer circumferential surface of the cylindrical portion 26.

Here, in a region which is located on the radially inner side of the first main body portion 22 and sandwiched between the first main body portion 22 and the diffuser portion 24, an annular gap A2 centered on the rotational axis O is provided. The flange portion 27 is disposed in the gap A2. Further, a surface of the flange portion 27 facing one side in the direction of the rotational axis O is a contact surface 27*a* which is in contact with the first main body portion 22. The contact surface 27*a* may also be a roughened surface. Further, a surface of the flange portion 27 facing the other side in the direction of the rotational axis O is disposed at a position separated from the diffuser portion 24 in the direction of the rotational axis O.

The scroll portion 12 of the present embodiment further includes a filling material 30 filled in the gap A2. Due to the filling material 30, the first main body portion 22 and the diffuser 24 are joined to each other.

Next, the rib 13 will be described.

The plurality of ribs 13 connect the outer circumferential surface 11*b* of the intake portion 11 and an outer surface 22*e* of the first main body portion 22 facing one side in the direction of the rotational axis O. The ribs 13 are made of resin similarly to the intake portion 11 and the first main body portion 22, and are formed, for example, integrally with the intake portion 11 and the first main body portion 22.

The ribs 13 are provided in the circumferential direction of the scroll portion 12 at intervals in the circumferential direction. The installation interval of the rib 13 in the circumferential direction gradually decreases from the winding start side to the discharge side. The ribs 13 extend in the radial direction on the outer surface 22*e* of the first main body portion 22 and are connected to the outer surface 22*e* throughout the entire extending direction of the rib 13 in the radial direction.

The radial length of the rib 13 on the outer surface 22*e* of the first main body portion 22 gradually decreases from the winding start side to the discharge side in the circumferential direction.

The rib 13 extend in the direction of the rotational axis O on the outer circumferential surface 11*b* of the intake portion 11 and are connected to the outer circumferential surface 11*b* of the intake portion 11 in the entire region in the extending direction of the rib 13 in the direction of the rotational axis O. The lengths of all the ribs 13 on the outer circumferential surface 11*b* of the intake portion 11 are the same.

The inner cylindrical portion 14 has a cylindrical shape centered on the rotational axis O, and the gas G flows through the inner side of the inner cylindrical portion 14. The end portion of the inner cylindrical portion 14 on one side in the direction of the rotational axis O is located on the other side in the direction of the rotational axis O than the end portion of the intake portion 11 on one side in the direction of the rotational axis O. That is, the inner cylindrical portion 14 is disposed on the inner circumferential side of the intake portion 11 and accommodated in the intake portion 11. The inner cylindrical portion 14 is made of a resin similarly to the intake portion 11. For example, the inner cylindrical portion 14 is integrally formed with the intake portion 11, the first main body portion 22, and the rib 13. That is, the intake portion 11 has a double pipe structure by the inner cylindrical portion 14.

In the present embodiment, the outer circumferential surface 14*a* of the inner cylindrical portion 14 is disposed at a position away from the inner circumferential surface 11*a* of the intake portion 11 in the radial direction. Further, an end portion of the inner cylindrical portion 14 on the other side in the direction of the rotational axis O is provided at an interval from an end portion of the diffuser portion 24 on one side in the direction of the rotational axis O. As a result, an annular slit SL centered on the rotational axis O is formed between the inner cylindrical portion 14 and the diffuser portion 24.

The inner rib 15 is provided between the outer circumferential surface 14*a* of the inner cylindrical portion 14 and the inner circumferential surface 11*a* of the intake portion 11 to extend in the direction of the rotational axis O. Also, a plurality of inner ribs 15 are provided at equal intervals in the circumferential direction.

As a result, spaces A1 communicating with the inner side of the inner cylindrical portion 14 are defined on both sides in the direction of the rotational axis O between the respective inner ribs 15. The spaces A1 communicate with the inner side of the inner cylindrical portion 14 via the slit SL on the other side of the rotational axis O. Also, the spaces A1 also open in the direction of the rotational axis O on the one side of the rotational axis O and communicate with the inner side of the inner cylindrical portion 14.

In the present embodiment, since the scroll portion 12 includes the sleeve 25, the portion of the inner rib 15 on the other side in the direction of the rotational axis O is connected to the inner circumferential surface 25*a* of the sleeve 25, and the portion of the inner rib 15 on one side of the rotational axis O is connected to the inner circumferential surface 11*a* of the intake portion 11.

In the compressor 1 of the present embodiment described above, since the plurality of ribs 13 are provided in the casing 10, it is possible to improve the rigidity in a portion in which the intake portion 11 and the scroll portion 12 are connected, and to suppress thermal deformation of the scroll portion 12. As a result, it is possible to suppress fluctuation of the tip clearance between the impeller 2 and the facing surface 24*a* of the diffuser portion 24, and to suppress the performance deterioration of the compressor 1.

Figure 4:
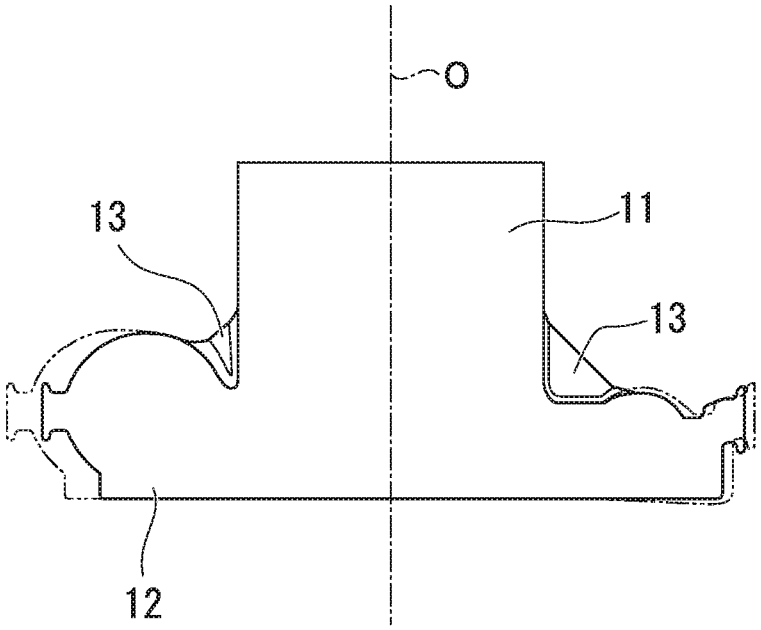
FIG. 4 is a longitudinal cross-sectional view schematically showing an aspect of thermal deformation of the casing for the radial compressor according to the embodiment of the present invention.

Furthermore, since the external shape dimension on the discharge side of the scroll portion 12 is larger than that of the winding start side, when thermally deformed at the same coefficient of thermal expansion, the amount of thermal deformation becomes larger on the discharge side than on the winding start side. In the present embodiment, by decreasing the installation interval of the ribs 13 toward the discharge side, as shown by the two-dot chain line on the left side of the page of FIG. 4, it is possible to suppress thermal deformation in the direction of the rotational axis O, while promoting thermal deformation in the radial direction of the scroll portion 12 on the discharge side. On the other hand, since the radial dimension of the rib 13 on the outer surface 22*e* of the first main body portion 22 of the scroll portion 12 increases on the winding start side, rigidity of the scroll portion 12 on the winding start side increases compared to the discharge side. Therefore, as shown by the two-dot chain line on the right side of the page of FIG. 4, relatively uniform thermal deformation occurs in the scroll portion 12 on the winding start side in the direction of the rotational axis O and the radial direction.

As a result, the amount of thermal deformation in the direction of the rotational axis can be made equal, on the discharge side in which the amount of thermal deformation in the direction of the rotational axis O is larger than the winding start side, and on the winding start side in which the amount of thermal deformation in the direction of the rotational axis O is smaller than the discharge side. That is, a change in tip clearance between the impeller 2 and the casing 10 can be reduced on the discharge side. Therefore, the tip clearance between the impeller 2 and the casing 10 can be made uniform in the circumferential direction. Therefore, it is possible to suppress performance deterioration of the compressor 1.

Figure 5:
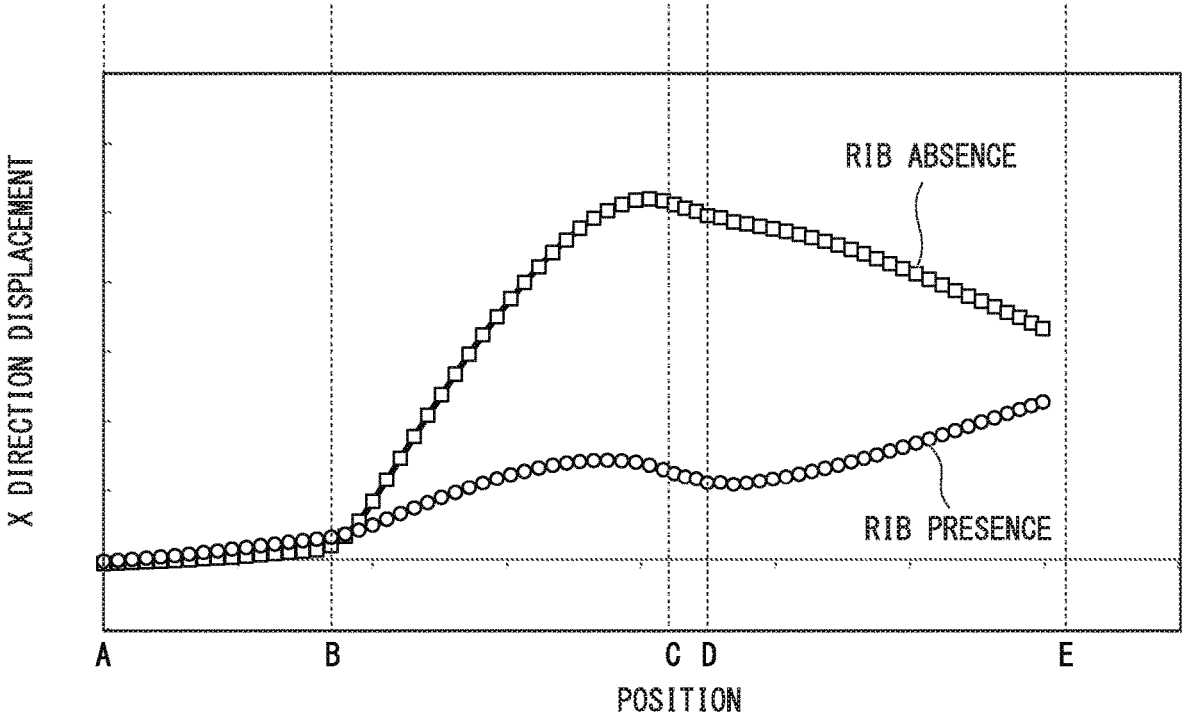
FIG. 5 is a graph showing a simulation result showing an amount of displacement due to thermal deformation at each position on a facing surface.
Figure 6:
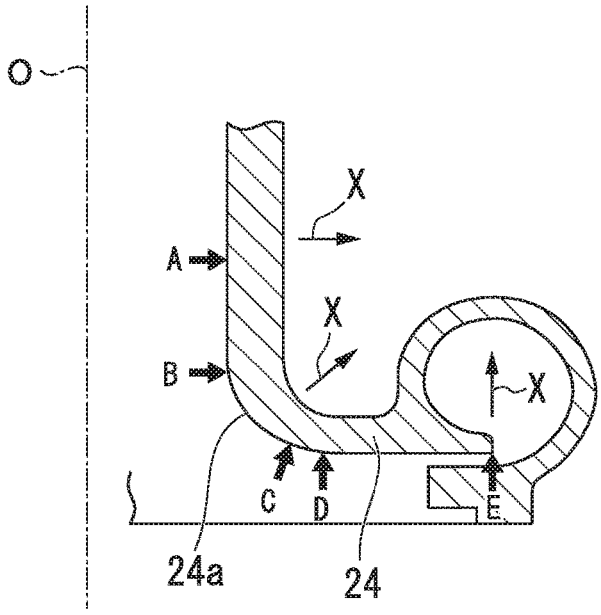
FIG. 6 is a schematic view showing respective positions on the facing surface on which a diffuser portion and the impeller face each other.

Here, a horizontal axis of the graph of FIG. 5 shows a distance from a reference position A (see FIG. 6) on the facing surface 24*a*, and a vertical axis shows an amount of displacement in a normal direction separated from the impeller 2. This amount of displacement is an average value for one turn in the circumferential direction at each position of positions B, C, D, and E on the facing surface 24*a* of each distance from the reference position A shown in FIG. 6. The reference position A is a position on the side of the intake portion 11 on the radially innermost side on the facing surface 24*a* and in the direction of the rotational axis O. Further, the position E is the position radially outermost side on the facing surface 24*a*. The position B is substantially the same position as the reference position A in the radial direction and is the position on the side closer to the impeller 2 in the direction of the rotational axis O than the reference position A. Further, between the position B and the position E, the position C is located on the radially inner side and the position D is located on the radially outer side.

According to FIG. 5, as compared with a case in which the ribs 13 are not provided, in a case in which the ribs 13 are provided as in this embodiment, it is possible to confirm that the amount of displacement in the direction (X direction in FIG. 6) away from the impeller 2 of the facing surface 24*a* can be suppressed to a smaller value over the whole of the facing surface 24*a*.

Further, by suppressing the amount of thermal deformation of the scroll portion 12 in the direction of the rotational axis O at the discharge side and by making the amount of deformation and the amount of displacement of the scroll portion 12 in the direction of the rotational axis O uniform in the circumferential direction, it is possible to suppress the inclination of the intake portion 11 with respect to the rotational axis O due to thermal deformation of the scroll portion 12 on the intake portion 11 side. Therefore, it is possible to suppress performance deterioration of the compressor 1.

Further, by providing the inner cylindrical portion 14 to make the intake portion 11 a double pipe structure and by fixing the intake portion 11 and the inner cylindrical portion 14 with the inner rib 15, it is possible to improve the rigidity of the intake portion 11. Therefore, thermal deformation of the intake portion 11 can be further suppressed. As a result, a change in tip clearance with the impeller 2 can be suppressed, and the performance deterioration of the compressor 1 can be suppressed.

Further, since the space A1 is formed between the intake portion 11 and the inner cylindrical portion 14, a part of the gas G flowing out from the impeller 2 can be returned to the intake portion 11 via the space A1, and can be made to flow into the impeller 2 through the inner side of the inner cylindrical portion 14 again. That is, the space A1 can be made to function as a recirculation path for the gas G. By the recirculation of the gas G, occurrence of surging can be suppressed and the operation range of the compressor 1 can be expanded.

Further, if it is intended to form the space A1 in which the gas G recirculate in the intake portion 11 without disposing the inner cylindrical portion 14, it is necessary to perform a process by inserting a tool into the narrow intake portion 11, it takes time and labor to process. However, in the present embodiment, since the inner cylindrical portion 14 is provided and the inner cylindrical portion 14 and the intake portion 11 are connected by the inner rib 15, it is possible to form the space A1 in which the gas G can recirculate between the inner ribs 15 adjacent to each other between the inner cylindrical portion 14 and the intake portion.

Further, since the intake portion 11 and the first main body portion 22 are made of resin, for example, they can be integrally molded by a technique such as injection molding. Therefore, it is possible to save time and labor for manufacturing, and it is possible to reduce the cost and shorten the manufacturing time.

Furthermore, a metallic sleeve 25 is provided to be in contact with the inner circumferential surface 11*a* of the intake portion 11 made of resin. Therefore, for example, if the insert molding in which the sleeve 25 is preliminarily inserted in the metal mold when injection-molding the intake portion 11 and the first main body portion 22 is performed, in the cooling step at the time of injection molding, it is possible to suppress deformation of the intake portion 11 and the first main body portion 22 due to shrinkage of the resin. Therefore, since the position deviation of the diffuser portion 24 does not occur due to the shrinkage deformation of the resin, the tip clearance with the impeller 2 can be set to the designed value, while eliminating the necessity of performing post-processing or the like on the facing surface 24*a*.

Even if the impeller 2 is broken, it is possible to prevent fragments of the impeller 2 broken by the metallic sleeve 25 from penetrating the first main body portion 22 and scattering to the outside of the compressor 1.

Further, since the first main body portion 22 and the diffuser portion 24 are fixed via the flange portion 27 of the sleeve 25, and the flange portion 27 is formed of metal, it is difficult to be thermally deformed. Therefore, it is possible to suppress a change in the relative position of the diffuser portion 24 with respect to the impeller 2 due to the thermal deformation of the first main body portion 22 made of resin or the intake portion 11 which are more greatly thermally deformed. Therefore, it is possible to suppress a change in tip clearance with the impeller 2. Therefore, the performance of the radial compressor 1 can be maintained.

Further, by the filling material 30 filled in the gap A2, which is a region sandwiched between the first main body portion 22 and the diffuser portion 24 around the flange portion 27 of the sleeve 25, it is possible to prevent the high-pressure gas G inside the scroll flow path 20 from flowing backward into the intake portion 11 through the gap A2. Therefore, the performance of the radial compressor 1 can be maintained.

Furthermore, since the surface of the sleeve 25 has a rough surface, and thus the sleeve 25 can be firmly fixed at a predetermined position with respect to the intake portion 11, it is possible to suppress the performance deterioration due to the positional deviation of the sleeve 25 during operation of the compressor 1.

In addition, since the first main body portion 22 and the second main body portion 23 have the protruding portions 22*b* and 23*b*, when the first main body portion 22 and the second main body portion 23 try to contract in the cooling step at the time of molding, the protruding portions 22*b* and 23*b* are caught by the resin molding metal mold 100. Therefore, shrinkage of the first main body portion 22 and the second main body portion 23 in the radial direction is suppressed, and the casing 10 can be manufactured with dimensions as designed. Therefore, it is possible to suppress the performance deterioration of the compressor 1.

Although the embodiments of the present invention have been described above in detail with reference to the drawings, the respective configurations and combinations thereof in the respective embodiments are merely examples, and additions, omissions, substitutions and other changes of configurations can be within the scope that does not depart from the gist of the present invention. Further, the present invention is not limited by the embodiments, but is limited only by the scope of the claims.

Figure 7:
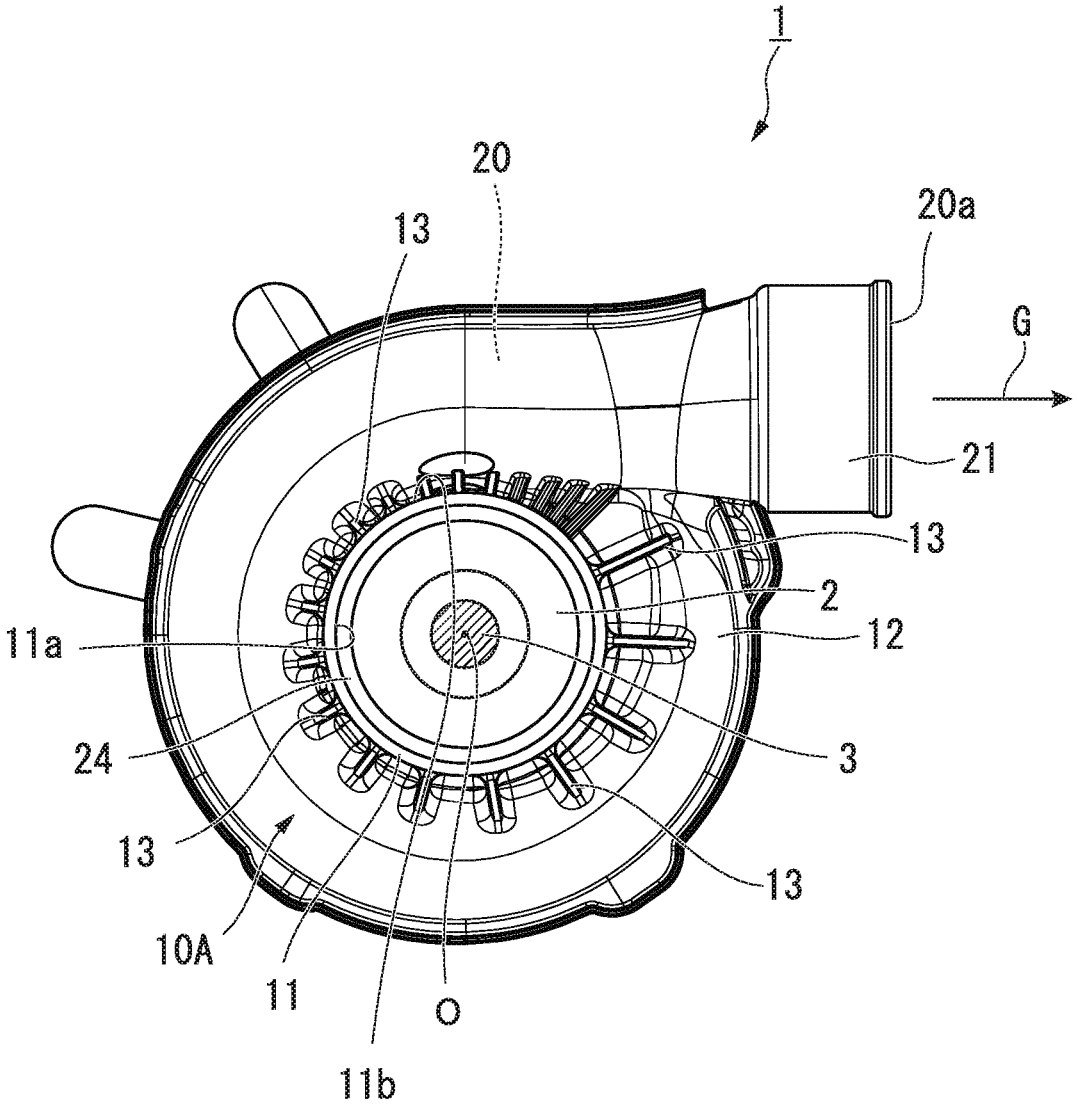
FIG. 7 is an overall top view of a radial compressor according to a modified example of the embodiment of the present invention.

FIG. 7 shows a casing 10A of a compressor 1 according to a modified example of the present embodiment.

In this modified example, the casing 10A does not have the inner cylindrical portion 14 and the inner rib 15. Even in such a casing 10A, similarly to the above-described casing 10, by providing a plurality of ribs 13 which connect the intake portion 11 and the scroll portion 12, it is possible to suppress performance deterioration due to thermal deformation of the scroll portion 12 of the casing 10A.

Further, for example, the material of the second main body portion 23 may be a material having a thermal conductivity higher than that of the first main body portion 22. That is, the second main body portion 23 may be formed of a composite material including a metal such as aluminum, carbon fiber, and a metal filler. As a result, since heat of the scroll portion 12 can be radiated from the second main body portion 23 to the other side of the rotational axis O, the temperature rise of the first main body portion 22 can be suppressed, which leads to an improvement in the performance of the compressor 1.

Further, only the inner cylindrical portion 14 may be provided inside the intake portion 11, and the inner rib 15 may not be provided. That is, it is not always necessary to form the space A1 serving as a recirculation path for the gas G.

The intake portion 11 does not necessarily need to be made of resin, and at least the first main body portion 22 may be made of resin.

Further, the scroll portion 12 may not be divided into the first main body portion 22, the second main body portion 23, and the diffuser portion 24. Also, the sleeve 25 may not be provided.

The sleeve 25 may not be provided with the flange portion 27. Further, the surface of the sleeve 25 may not necessarily be a roughened surface.

INDUSTRIAL APPLICABILITY

According to the casing for the radial compressor and the radial compressor, it is possible to suppress performance deterioration due to thermal deformation of the scroll portion.

REFERENCE SIGNS LIST

1 Radial compressor
2 Impeller
3 Rotary shaft
10, 10A Casing
11 Intake portion
11*a* Inner circumferential surface
11*b* Outer circumferential surface
12 Scroll portion
13 Rib
14 Inner cylindrical portion
14*a* Outer circumferential surface
15 Inner rib
20 Scroll flow path
20*a* Opening portion
20*b* Opening portion
21 Discharge port
22 First main body portion
22*a* Annular portion
22*b* Protruding portion
22*c* Surface
22*d* Recessed portion
22*e* Outer surface
23 Second main body portion
23*a* Annular portion
23*b* Protruding portion
23*c* Surface
23*d* Recessed portion
24 Diffuser portion
24*a* Facing surface
25 Sleeve
25*a* Inner circumferential surface
26 Cylindrical portion
27 Flange portion
27*a* Contact surface
30 Filling material
A1 Space
A2 Gap
SL Slit
O Rotational axis
G Gas

What is claimed is:

1. A casing for a radial compressor comprising:

an intake portion which has a cylindrical shape, extending in a direction of a rotational axis of an impeller and opening in the direction of the rotational axis and is configured to introduce gas into the impeller;

a scroll portion which is disposed on an outer circumferential side of the impeller and the intake portion to extend in a circumferential direction, has a discharge port opening in the circumferential direction and a scroll flow path through which the gas from the impeller flows toward the discharge port, and includes a resin material having a gradually increasing external shape dimension; and a plurality of ribs which connect an outer circumferential surface of the intake portion and an outer surface of the scroll portion, wherein the plurality of ribs are provided at intervals in the circumferential direction, an installation interval gradually decreases, and a length dimension in a radial direction on the outer surface of the scroll portion gradually decreases toward the discharge port in the circumferential direction.

2. The casing for the radial compressor according to claim 1, further comprising:

an inner cylindrical portion which is disposed on an inner circumferential side of the intake portion and forms a cylindrical shape through which the gas flows; and an inner rib which is configured to connect the inner circumferential surface of the intake portion and the inner cylindrical portion.

3. The casing for the radial compressor according to claim 2, wherein a space communicating with an inner side of the inner cylindrical portion is defined between the intake portion and the inner cylindrical portion on both sides of the inner cylindrical portion in the direction of the rotational axis.

4. The casing for the radial compressor according to claim 1, wherein the intake portion is made of resin, the scroll portion includes:

a first main body portion made of resin and which forms an inner surface of the scroll flow path at one side in the direction of the rotational axis, a second main body portion which faces the first main body portion in the direction of the rotational axis and forms an inner surface of the scroll flow path at the other side in the direction of the rotational axis, a diffuser portion which is disposed at a position sandwiched between the intake portion and the impeller in the direction of the rotational axis on an inner side in the radial direction of the second main body portion, forms an inner surface on the inner side in the radial direction of the scroll flow path, and is configured to guide the gas from the impeller to the scroll flow path, and a metallic sleeve having a cylindrical shape which is disposed at a position sandwiched between the diffuser portion and the intake portion in the direction of the rotational axis and comes into contact with the inner surface of the intake portion.

5. The casing for the radial compressor according to claim 4, wherein the sleeve includes:

a cylindrical portion extending in the direction of the rotational axis, a flange portion which annularly protrudes radially outward at an end portion on the other side in the cylindrical portion, is disposed in a region sandwiched between the first main body portion and the diffuser portion in the direction of the rotational axis, and in which a surface facing one side in the direction of the rotational axis comes into contact with the first main body portion, wherein the scroll portion further includes a filling material filled into the region in which the flange portion is disposed.

6. The casing for the radial compressor according to claim 4, wherein the surface of the sleeve is a rough surface.

7. The casing for the radial compressor according to claim 4, wherein a material of the second main body portion is a material having a thermal conductivity higher than that of a material of the first main body portion.

8. A radial compressor comprising:

an impeller;

a rotary shaft to which the impeller is fitted and which rotates together with the impeller; and the casing according to claim 1 which covers the impeller.

* * * * *